US006644383B2

(12) United States Patent
Joseph et al.

(10) Patent No.: US 6,644,383 B2
(45) Date of Patent: Nov. 11, 2003

(54) SELF-HEATING/SELF-COOLING PACKAGE

(75) Inventors: Gary Curtis Joseph, Mason, OH (US); Christopher Lee Daum, Coral Springs, FL (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/185,948

(22) Filed: Jun. 28, 2002

(65) Prior Publication Data

US 2003/0000517 A1 Jan. 2, 2003

Related U.S. Application Data

(60) Provisional application No. 60/302,224, filed on Jun. 29, 2001.

(51) Int. Cl.[7] ..... F28F 7/00

(52) U.S. Cl. ..... 165/46; 126/263.01; 62/4

(58) Field of Search ..... 165/46; 126/263.01, 126/263.04, 263.07, 263.08, 263.09; 62/4, 60

(56) References Cited

U.S. PATENT DOCUMENTS

| | | | | | |
|---|---|---|---|---|---|
| 3,865,117 | A | * | 2/1975 | Perry, III | 607/114 |
| 4,856,651 | A | * | 8/1989 | Francis, Jr. | 206/219 |
| 5,915,461 | A | * | 6/1999 | Tanhehco | 165/46 |
| 6,231,596 | B1 | * | 5/2001 | Collins | 607/114 |
| 6,289,889 | B1 | * | 9/2001 | Bell et al. | 126/263.07 |
| 6,484,514 | B1 | * | 11/2002 | Joseph et al. | 62/4 |
| 6,513,516 | B2 | * | 2/2003 | Sabin et al. | 126/263.01 |

* cited by examiner

*Primary Examiner*—Terrell L Mckinnon
(74) *Attorney, Agent, or Firm*—Peter D. Meyer

(57) ABSTRACT

A flexible temperature changing package for heating or cooling a contained item or product including a temperature changing element adjacent to the item and an offset activation point that prevents damage to item.

20 Claims, 9 Drawing Sheets

SELF-HEATING/SELF-COOLING PACKAGE

This Application claims priority from U.S. Provisional Application Serial No. 60/302,224, filed Jun. 29, 2001, and herein incorporated by reference.

FIELD OF THE INVENTION

The present invention relates to a flexible heating or cooling system for heating, or cooling, a contained item or product.

BACKGROUND OF THE INVENTION

Various types of self-heating/self-cooling containers are known in the art for heating or cooling the contents held within the container to a desired temperature.

In one type of self-heating/self-cooling containers, the containers function solely as receptacles into which the final user may place any item they desire to heat/cool. Some of these receptacles are designed with a certain product in mind, such as a standard size can of food or beverage. For example, U.S. Pat. No. 2,425,900 describes a package that is readily transportable and adapted to receive any standard can suitable for the size of the package.

Several examples of flexible self-heating/self-cooling containers exist in the literature. The inventions disclosed in U.S. Pat. No. 5,465,707 uses an electrolytic-solvent to activate exothermic-chemical pad or powder. The exothermic-chemical pad is enclosed within an absorbent envelope and the electrolytic-solvent is contained within a bag. It also discloses a pouch for foodstuff. U.S. Pat. No. 5,465,707 discloses an invention that consists of a thermal insulated outer barrier layer in which is contained the exothermic-chemical pad, the electrolytic solvent containing bag, and the pouch for foodstuff. The solvent bag is affixed to a board material, which provides a rigid structure for the proper functioning of a tear filament pull-tab mechanism or a means for rupturing the solvent bag. To properly work, this package must have a specific orientation and cannot be moved about once activated because of the potential to spill the activating fluid, i.e., it is not self-contained.

U.S. Pat. No. 3,685,507 describes as one embodiment a multi-walled container unit fabricated of plastic film, which is comprised of three flexible bags of plastic film. An outer bag within which is suspended an inner bag of shorter length. The outer bag also has disposed in its bottom a charge of chemical and a small plastic bag, which has sealed therein a charge of a second chemical. The bulk of the heating element and thus the chemical reaction is located at the bottom of the package. This is undesirable because the heating element is not disposed adjacent and along the product to be heated or cooled. Because of this, it is suggested that the heating or cooling is inefficient. Also, the patents suggests that shaking or inverting the package would to disperse the contacted chemicals throughout the container and into the annular mixing space.

U.S. Pat. No. 4,838,242 describes a device for changing the temperature of material placed therein by a user. The device comprises an inner flexible cylindrical member having an open end for receiving and changing the temperature of an item such as a can of soda or food and a temperature changing element within the walls of the cylindrical member. However, this device does not permit the activation of the heating or cooling element while the item to be heated or cooled is within the cylindrical member without damaging the item, i.e., no offset activation point.

U.S. Pat. No. 5,263,991 describes a thermal packaging unit for heating a biocompatible implant that is self-contained in that the elements used for heating the biocompatible device are located within the thermal packaging unit. To provide means for heating the biocompatible implant, the thermal packaging unit includes a first compartment that is operable to contain calcium chloride, that defines a storage area for receiving the biocompatible implant, and a second compartment disposed within the first compartment that is operable to contain water. When the wall of the second compartment is ruptured, as by gently squeezing the thermal packaging unit, water from the second compartment is able to combine with the calcium chloride in the first compartment in an exothermic reaction. Again, this device does not include an offset activation point that will permit activation of the temperature changing element without damaging the item to be heated or cooled.

None of these patents address the issue of providing a solid-liquid-, or liquid liquid-interaction, or crystallization of a supercooled solid-based thermal regulation source in a flexible container while providing for an activation method that will prevent the accidental damage of the product contained within the package. Also, none of these patents address the problem of maintaining the integrity of the structure containing the reactive chemistry. Further, the system is characterized by providing optimal heat transfer by having the heat source adjacent to the item to be heated.

SUMMARY OF THE INVENTION

The present invention is directed to a flexible heating/cooling system comprising an enclosed package containing a product and at least two flexible temperature changing elements. Each flexible temperature changing elements comprises a first chamber and a second chamber disposed proximate to the first chamber. At least a portion of the at least two flexible temperature changing elements is disposed proximate to the product so that thermal energy from the at least two flexible temperature changing elements heats or cools the product.

DETAILED DESCRIPTION OF THE INVENTION

The present invention is a heating, or cooling, temperature changing package 30 for use with an item 12 to be heated, or cooled, with an exothermic, or endothermic, reaction upon activation. The disclosure will focus on heating an item 12 with an exothermic chemical reaction. Exemplary, but non-limiting, exothermic chemical reactions, include water reacting with quicklime (Calcium Oxide), calcium chloride, magnesium sulfate, and/or anhydrous zeolite formations, electrochemical systems (e.g., a magnesium/magnesium alloy coupled with an electrolyte solution), crystallization of a super-cooled saturated salt solution, and combinations thereof. "Activation", as used herein, is a method or action taken to initiate an exothermic, or endothermic, chemical reaction system. Activation may be characterized by the application of a linear force, torsional bending, removal of a separation, or combinations thereof.

Preferably, an integrated self-heating package is formed from a multiple layered structure. "Integrated", as used herein, means that a temperature changing element is part of the packaging rather than a separate unit located within the packaging.

Figure 1:
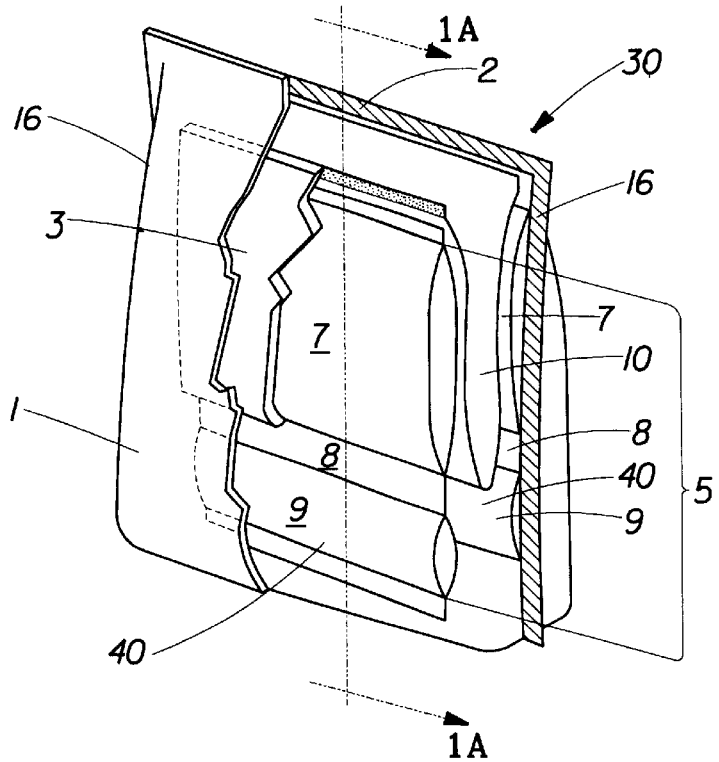
FIG. 1 is a perspective view of an exemplary embodiment of a package of the present invention.
Figure 1A:
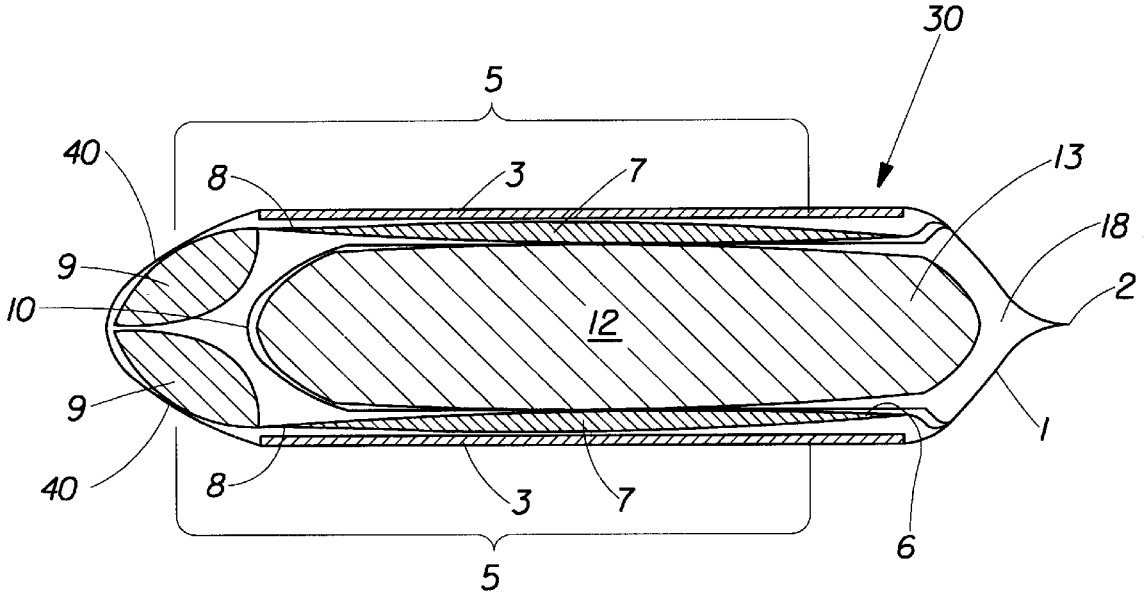
FIG. 1A is a cross-sectional view of the embodiment of FIG. 1 taken along line 1A—1A.
Figure 2:
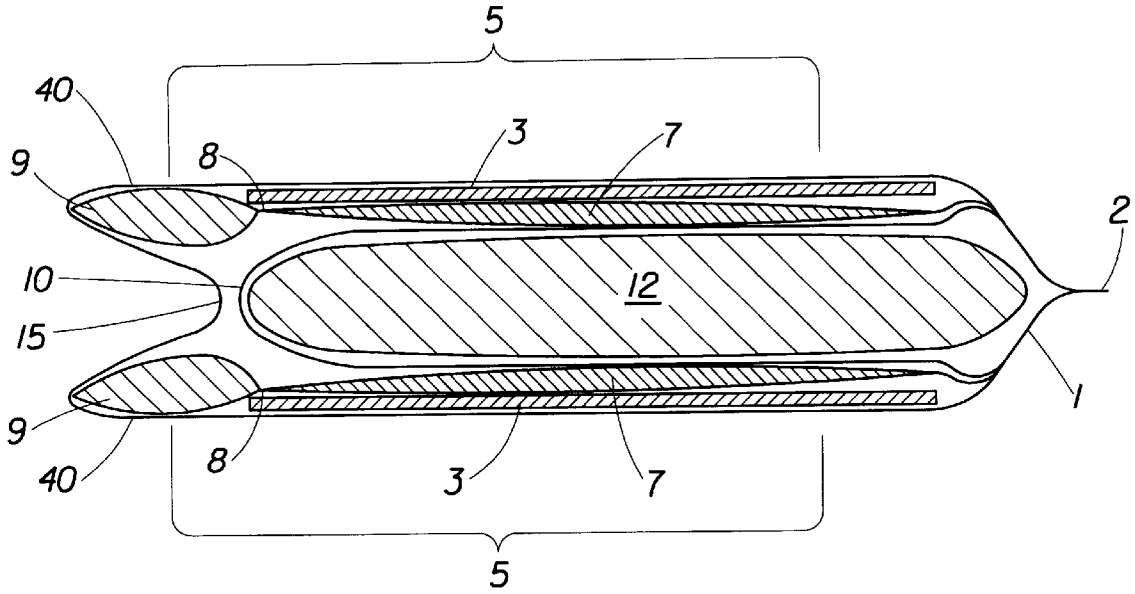
FIG. 2 is a cross-sectional view of an alternative embodiment of a package.
Figures 3, 3A:
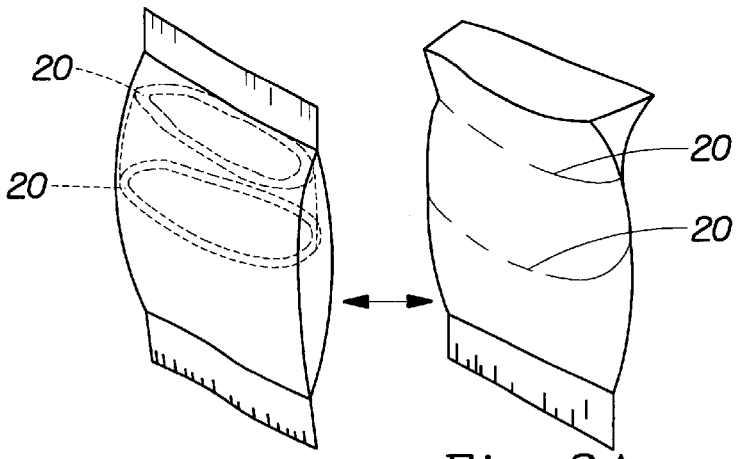
FIG. 3 is a perspective view of an alternative embodiment of a sealed outer container.
FIG. 3A is a perspective view of the embodiment of FIG. 3 in an open condition.

FIGS. 1 and 1A detail a preferred embodiment of a self-heating package (package) 30. Package 30 can include outer walls 1. Outer walls 1 can be comprised of a paper board material, flexible film material (e.g., foil, paper, or plastic), metallized plastic or paper, metallized films, preferably with an internal sealing layer (i.e., Surlyn® or LDPE), any other heat sealable polymeric film, and combinations thereof. In a preferred embodiment, outer walls 1 are manufactured from a 5 mil (127 $\mu$m) paper/foil/LDPE laminate film cut to a 5½-inch×14-inch (13.97 cm×35.56 cm) sheet. Preferably, two side edges 16 of outer walls 1 are sealed to form a pouch 10 with an opening 18, wherein opening 18 is defined by two top edges 2 of outer walls 1. This film can be folded, as is known to one of skill in the art, with a single fold, or with a "W" fold, to form a gusseted bottom 15 as shown in FIG. 2. Alternatively, as shown in FIG. 3, two bottom edges of outer walls 1 can be sealed together to enclose, or form, a bottom of package 30. Additionally, outer walls 1, when connected to form package 30, can form a pocket 13 capable of holding item 12 within package 30 so that item 12 can be heated, or cooled. Opening 18 can permit placement of item 12 within pocket 13 of package 30. Once item 12 is placed in pocket 13 of package 30, opening 18 can be thermally, ultrasonically, adhesively, or physically sealed (with a clamp, tie, or zipper closure) across the top edge 2.

Outer walls 1 can provide a barrier for item 12 contained within package 30. As would be known to a skilled artisan, outer walls 1 should be capable of withstanding the temperatures developed by a chemical reaction within package 30. Additionally, upon opening package 30, a formed plastic or wire ring 20, as shown in FIGS. 3 and 3A, can maintain the pouch in an open, cup-like form. This can be surprisingly beneficial by adding structure to a collapsible package containing a liquid item 12.

Figure 4:
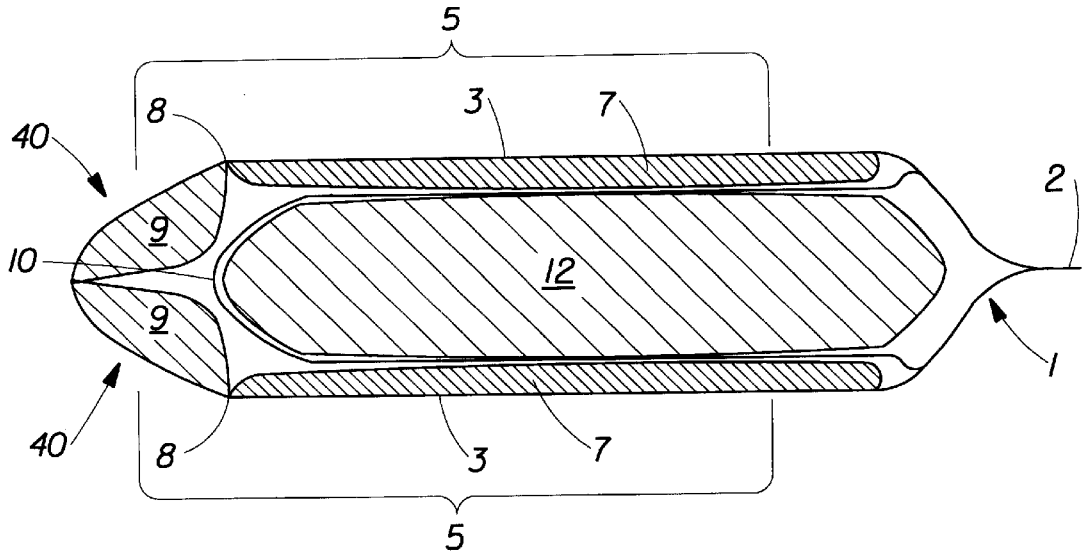
FIG. 4 is a cross-sectional view of an alternative embodiment of a package.

Package 30 can also include a temperature changing element 5. Temperature changing element 5 can include an exothermic, or endothermic, system that provides heating, or cooling, for item 12 contained within package 30. Temperature changing element 5 can be fixably attached to the inner surface of outer walls 1 as shown in FIGS. 1–3. Alternatively, temperature changing element 5 can be formed to be integral with outer walls 1 as shown in FIG. 4 (i.e., temperature changing element 5 and outer walls 1 share a common wall). Preferably, temperature changing element 5 is a self-contained, two chamber system comprising a first chamber 9 and a second chamber 7 separated by a frangible seal 8. Frangible seal 8 can be ruptured by pressure applied to one or more of first chamber 9 and second chamber 7. First chamber 9 can contain a first material and second chamber 7 may contain a second material. "Self-contained temperature changing element", as used herein, means a heating or cooling element wherein all materials and the resultant reaction are held within an enclosed boundary, for instance, a package. Thus, the materials incorporated into temperature changing element 5 cannot access pocket 13 of package 30 thereby preventing intermixing with item 12. As one of skill in the art would realize, other types of temperature changing elements may be used.

Package 30 preferably includes an offset activation point. An "offset activation point" means a point or mechanism displaced away from item 12 so that when temperature changing element 5 is activated, item 12 is not damaged or destroyed. As one of skill in the art would appreciate, an offset activation point can be a separate device or, as in the preferred embodiment, can be integral with temperature changing element 5. Generally, temperature changing element 5 is activated at the first chamber of temperature changing element 5 (i.e., the first chamber of temperature changing element 5 is the activation point 40).

Referring to FIGS. 7–18, temperature changing element 5 can include heating and/or cooling by chemical reactions, not limited to, solid-liquid, liquid—liquid, anhydrous, heat of solution, crystallization, electro-chemical, zeolite-liquid, heat of neutralization, and combinations thereof.

An embodiment of temperature changing element 5 may include a solid-liquid or liquid—liquid heating and/or cooling systems, such as anhydrous reaction systems, heat of solution systems, zeolite systems, and electrochemical systems A "solid-liquid heating/cooling system" means any exothermic, or endothermic, change that occurs during the combination, or mixing, of two or more components, where at least one system component is liquid (e.g., water) and one component is solid (e.g., anhydrous salts). A "liquid—liquid heating and/or cooling system" means any exothermic, or endothermic, change that occurs during the combination, or mixing, of two or more components, where two or more system components are liquid.

As shown in FIGS. 7–18, in preferred embodiments, temperature changing element 5 can comprise a self-enclosed system having a substantially moisture impermeable outer layer 246. Moisture impermeable outer layer 246 can be flexible or rigid. For example, the water impermeable outer layer may be a metallized film, foil laminate film, MYLAR™, a formed metal sheet, or any other water and/or moisture impermeable material. The water moisture impermeable outer layer 246 may also include a material having optimized thermal conductive parameters such as a metallized foil that can permit increased thermal diffusivity and/or conductivity.

Figure 7:
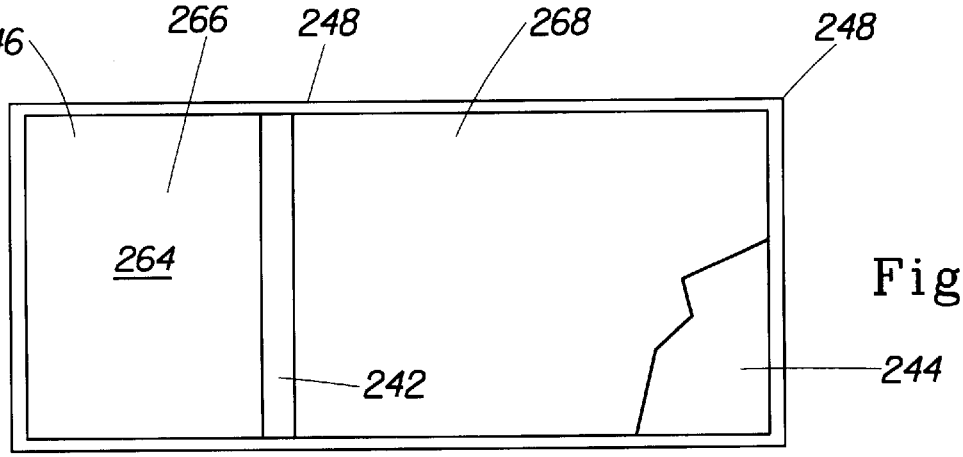
FIG. 7 is a plan view of an exemplary temperature changing element.
Figure 8:
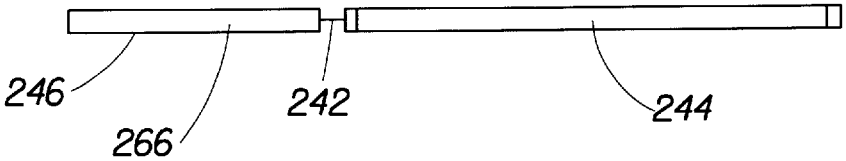
FIG. 8 is an elevational view of the exemplary temperature changing element of FIG. 7.

The embodiments as shown in FIGS. 7 through 16 show a temperature changing element 5, including a solid-liquid and/or liquid—liquid heating/cooling system, including multiple components of temperature changing element 5 housed in adjacent chambers separated by a rupturable barrier or seal 242, for example, a frangible seal. Temperature changing element 5 can include a water impermeable layer 246 formed into a pouch having two or more chambers that separately house solid and/or liquid materials of the system prior to activation. As shown in FIGS. 7 and 8, temperature changing element 5 can be permanently sealed about its periphery 248 to include a first chamber 266 and a second chamber 268. Upon compression of one or more chambers of the temperature changing element 5, rupturable seal 242 may rupture allowing a liquid material(s) 264 (e.g., water) to flow into contact with a solid material(s) 244 (e.g., anhydrous salt, electro-chemical alloys) of a solid-liquid system and the other liquid material(s) in a liquid—liquid heating system. As shown in FIG. 7, both chambers may be interchanged. Applying pressure to one or more of the chambers such as squeezing, pressing, kneading, etc. can rupture the frangible seal 242 facilitating mixing of the materials contained within of the first chamber 266 and second chamber 268 thereby releasing or absorbing energy from the environment.

Figure 9:
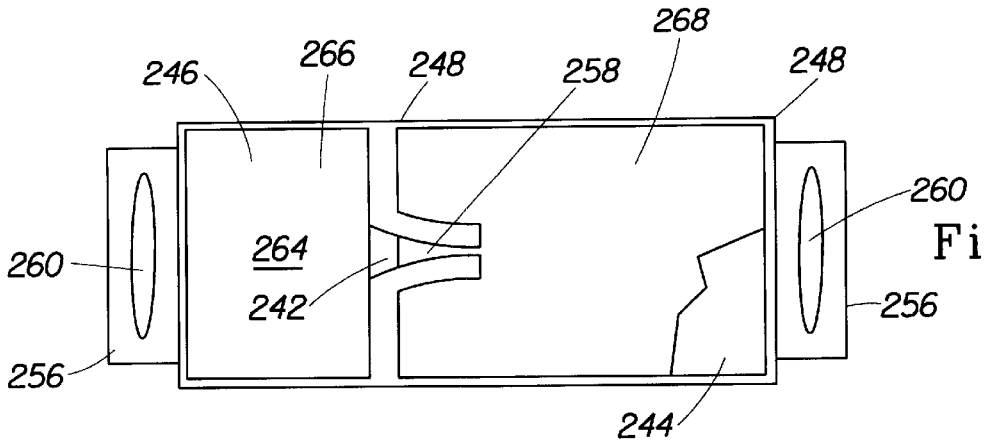
FIG. 9 is a plan view of an exemplary temperature changing element.
Figure 11:
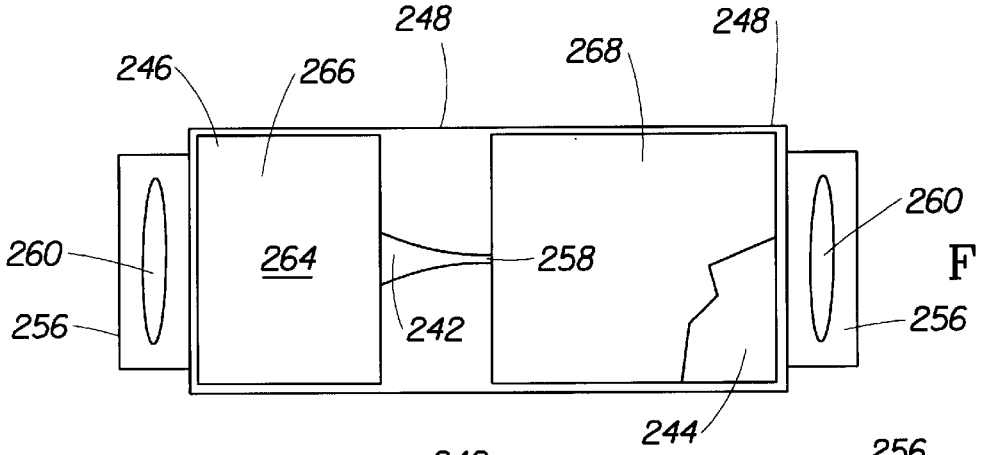
FIG. 11 is a plan view of an exemplary temperature changing element.
Figure 12:
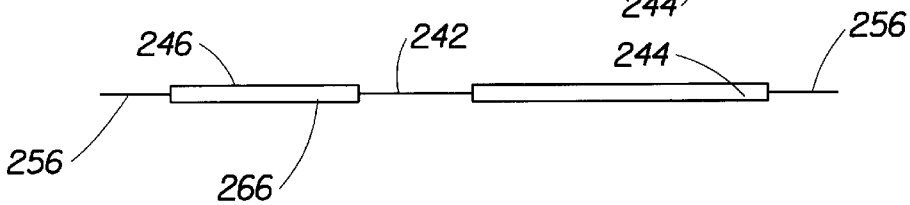
FIG. 12 is an elevational view of the exemplary temperature changing element of FIG. 1.
Figure 13:
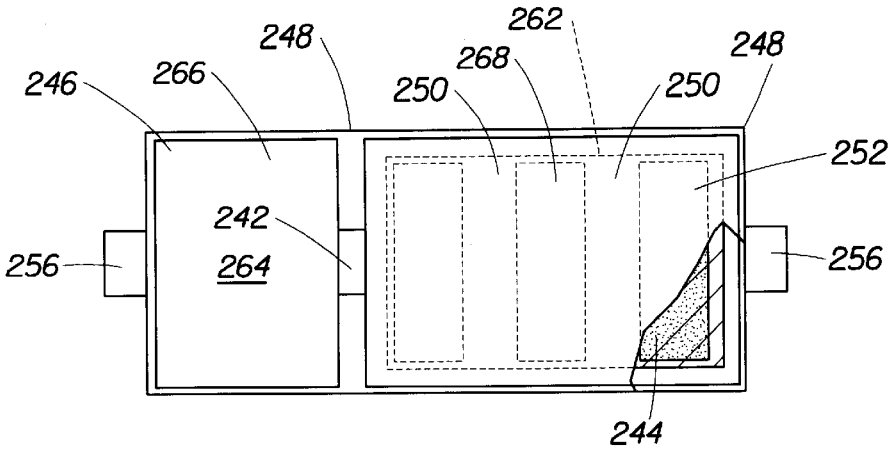
FIG. 13 is a plan view of an exemplary temperature changing element.
Figure 14:
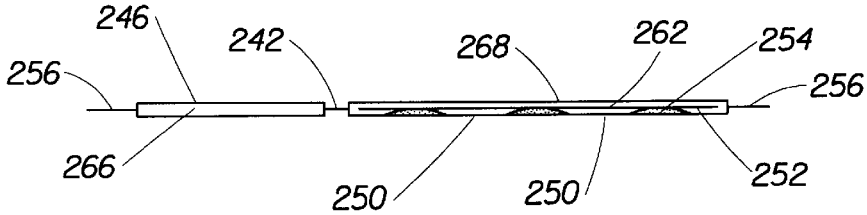
FIG. 14 is an elevational view of the exemplary temperature changing element of FIG. 13.
Figure 15:
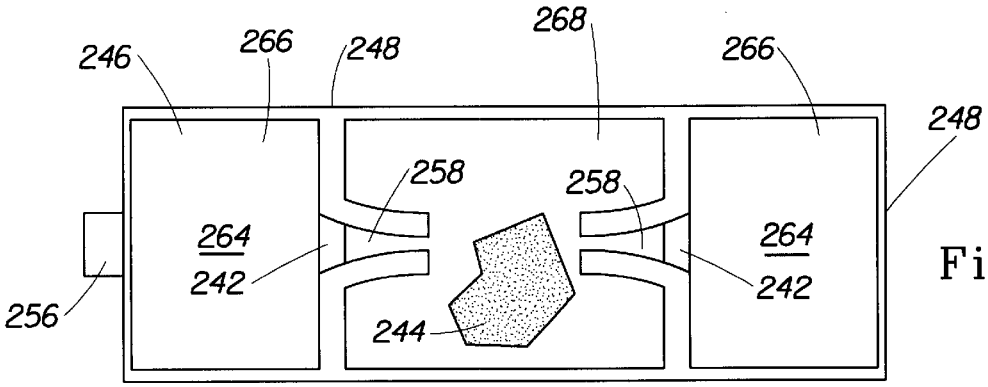
FIG. 15 is a plan view of an exemplary temperature changing element.

FIGS. 9, 10, 13, and 14 are alternative embodiments showing temperature changing element 5 including a liquid material 264 housed in a first chamber 266 and a solid material 244 housed in a second chamber 268 separated by a frangible seal 242. In these embodiments, a frangible seal 242 separates the first chamber 266 from the second chamber 268. The frangible seal 242 can extend a portion of the width of the temperature changing element 5 as shown in FIGS. 9–16, or can extend the entire width of the temperature changing element 5 between the first and the second chambers 266 and 268 as shown in FIGS. 7 and 8. In one embodiment, a frangible seal may be designed narrowly, as shown in FIGS. 9, 13, and 15 in order to minimize backflow of the liquid material 264 into the first chamber 266 after activation. Alternatively, or additionally, the temperature changing element 5 can also include a progressively narrowing channel 258 such as shown in FIG. 9 that can further restrict the backflow of liquid material 264 into the first chamber 266 after activation.

Figure 10:
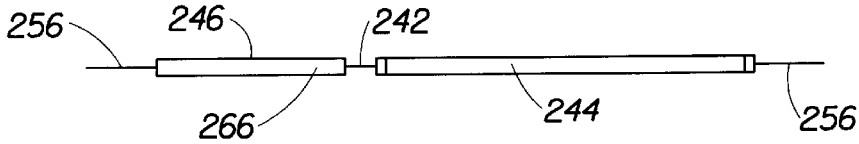
FIG. 10 is an elevational view of the exemplary temperature changing element of FIG. 9.

FIGS. 9 and 10 depict another embodiment of a temperature changing element 5 that can be used in a solid-liquid or liquid—liquid heating, or cooling, system. A first liquid material is housed in a first chamber 266 and a second liquid material or solid material housed in a second chamber 268. The frangible seal 242 can extend across all or a portion of the width of the heating, or cooling, element. Further, channel 258 can extend into the second chamber 268 in order to prevent a backflow of the first and second liquid materials into the first chamber 266 after activation. Alternately, FIGS. 11 and 12 show a temperature-changing element 5 where exit channel 258 is located within seal area 248, allowing for full use of the heating chamber.

Figure 16:
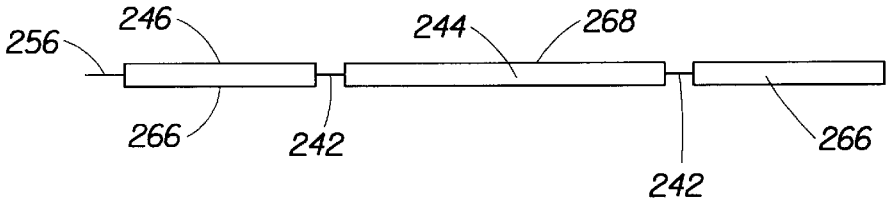
FIG. 16 is an elevational view of the exemplary temperature changing element of FIG. 15.

FIGS. 15 and 16 shows a temperature-changing element 5 with at least two channels 258 that can be used in a solid-liquid or a liquid—liquid heating/cooling system for a substantially one-way flow of fluid into chamber 268. This allows for delivery of the fluid material to multiple locations within the chamber 268. This can be useful in larger packages where fluid wicking can be difficult.

In the case of a solid-liquid system, temperature changing element 5 can also include a solid material 244. The solid material 244 can be contained loosely within the water impermeable outer layer 246, as shown in FIGS. 7–12 and 15–18, or contained within one or more porous, liquid permeable compartments 254 contained within second chamber 268 as shown in FIGS. 13 and 14. The compartments 254 can be formed by a porous material such as a porous cellulosic material (e.g., wet-laid or air-laid), a porous polymeric film such as a polyethylene film which has been needle-punched or vacuumed-formed, a polymeric mesh material such as a woven nylon mesh material such as Nitex™ supplied by Sefar America Inc., Depew, N.Y. etc. Preferably, the pore size of the porous material is smaller than the particles of the solid in the case of a solid-liquid system material(s) 244. The heat generator can also include one or more compartments that house the solid material(s) 244. Without wishing to be bound by theory, it is believed that solid material(s) can be packed within one or more compartments of the heating chamber at a material volume of about 60% to about 95% of the available compartment space in order to keep the solid material in close proximity to each other. Tight packing of solid material(s) in one or more compartments of the pouch can prevent the solid material(s) from shifting in temperature changing element 5 and can also prevent "saddle-bagging." It is further believed that keeping a solid material(s) in a packed state within one or more compartments can promote even heating, or cooling, in the temperature changing element 5 via a defined and repeatable amount of component per unit volume. It is further believed that this can reduce the material surface area exposure thus, reducing rapid heat losses of the temperature changing element 5 in exothermic systems. This can result in an effective manner in which to meter the rate that the heat produced, or consumed, by the exothermic, or endothermic, system due to forced conduction through a packed bed. In alternative embodiments, the pouch may further distribute the liquid material(s) 264 across the surface of the solid material(s) 244 of the solid-liquid system through wicking and/or capillary action.

Additionally, a liquid distribution layer such as the layer 262 can be provided in proximity to the solid material(s) 244 of the solid-liquid system to distribute the liquid material(s) 264 across the surface of the solid material(s) 244 through wicking and/or capillary action such as shown in FIGS. 13 and 14. It is believed that this can be useful when solid material(s) are contained in a porous sheet that will not readily wick the aqueous solution across its surface or when the solid materials are contained loosely within a water impermeable outer layer 246. An exemplary liquid distribution layer can include a cellulosic material such as paper towel layers such as Bounty®, sold by The Procter & Gamble Company, Cincinnati, Ohio, capillary channel fibers, hydrophilic woven and non-woven materials, Dri-Weave®, or any other distribution materials known to one of skill in the art. Further, materials such as cellulosic materials, superabsorbent polymers, and/or other hydroscopic materials, may be interspersed within the particles of the solid material(s) in order to allow for a more even dispersion of the liquid material(s) throughout the solid material(s) and a more and full usage of the material(s). This may be especially useful in embodiments where the solid material(s) are mixed with additives such as encapsulated phase change materials such as Thermasorb Series® available from Frisby Technologies, Winston-Salem, N.C., or polyethylene powders that are slightly hydrophobic.

Further, the addition of cellulosic materials can be beneficial in embodiments where another additive such as guar or xanthan gum is added to the reactant material(s) to help tailor the temperature profile but may also affect the rate at which the reaction occurs due to a viscosity change in an aqueous solution liquid material. Further, the addition of cellulosic materials may also be beneficial where reactive materials such as magnesium sulfate or calcium chloride, in a packed form, will form a thin crystal sheet across the areas where the water first comes in contact with them. This may impede the progress of the water to areas of the packed bed that are below the crystal surface.

Exothermic solid-liquid heating systems can include solid materials such as calcium oxide, calcium carbonate, calcium sulfate, calcium chloride, cerous chloride, cesium hydroxide, sodium carbonate, ferric chloride, copper sulfate, magnesium sulfate, magnesium perchlorate, aluminum bromide, calcium aluminum hydride, aluminum chloride, sulfur trioxide (alpha form), zeolites (e.g., Carbsorb® 500 Series natural zeolite based on the mineral chabazite), mixtures thereof and other solid components of solid-liquid exothermic systems known in the art and combinations there of. An endothermic solid-liquid cooling system can include solid materials such as sodium sulfate*$10H_2O$, sodium bicarbonate, potassium perchlorate, potassium sulfate, potassium chloride, potassium chromate, urea, vanillin, calcium nitrate, ammonium nitrate, ammonium dichromate, ammonium chloride and other solid components of endothermic systems known in the art. These solid materials can be in an anhydrous form and can be used in a powder, granular, and/or prilled condition. These materials are generally hydroscopic and dissolve in or react with a liquid component, such as water, and give off, or absorb, heat.

Further exothermic solid-liquid systems can include an electrochemical reaction including solid materials such as iron, magnesium, aluminum, or combinations thereof, that react in the presence of salt and water. In these embodiments, the liquid material may include a salt-water solution or may include water if salt is included with the solid material(s) 244.

Yet another solid-liquid or liquid—liquid exothermic system includes systems that use the heat of neutralization to exude heat using acid and base materials such as citric acid having a pH of about 3 or 4 and calcium hydroxide having a pH of 12 in an approximate 2 to 1 ratio.

Figure 17:
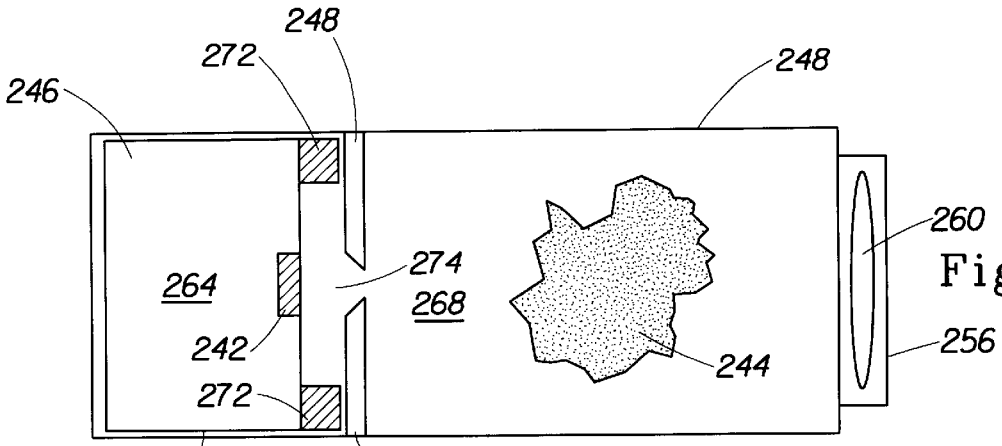
FIG. 17 is a plan view of an exemplary temperature changing element.
Figure 18:
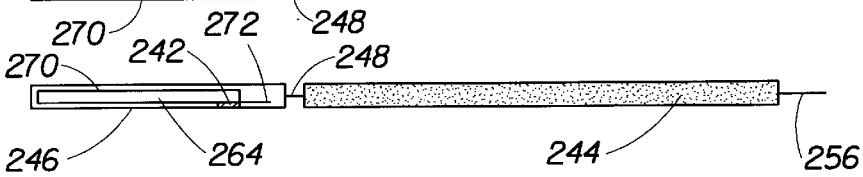
FIG. 18 is an elevational view of the exemplary temperature changing element of FIG. 17.

As shown in FIGS. 17 and 18, temperature changing element 5 can include a separate rupturable pouch 270 containing a liquid material 264, inside of a second larger 246 pouch containing a solid or secondary liquid material 244 of a solid-liquid or liquid—liquid system. Heat-sealing, adhesive, or other attachment method 272 can fix the location of separate rupturable pouch 270 in second larger pouch 246. This can result in separate rupturable pouch 270 being offset from item 12 when second larger pouch 246 is incorporated into a heating package. The element can also include a seal about the periphery and across the width of pouch 248 to separate the large pouch 246 into two smaller chambers 266 and 268. Chambers 266 and 268 can be connected by a small gap 274 in the seal across the width 248. Small gap 274 can allow water to enter upper chamber 268 from lower chamber 266 once it is released from rupturable pouch 270.

The rupturable pouch 270 can be formed from a metallized film or other material having a low moisture vapor transmission rate (MVTR) in order to minimize losses of the liquid component(s) 264 prior to activation of the temperature changing element 5. The rupturable pouch 270 can also include frangible seal 242 to facilitate rupturing the seal by squeezing or otherwise applying pressure to the temperature changing element 5. Alternatively, the rupturable pouch 270 can include weakened portions in the pouch material such as scores, perforations, pull tabs, metal shavings, or other items that can puncture the rupturable pouch 270 upon the application of pressure, or other method of rupturing a pouch known to one of skill in the art.

Figure 23:
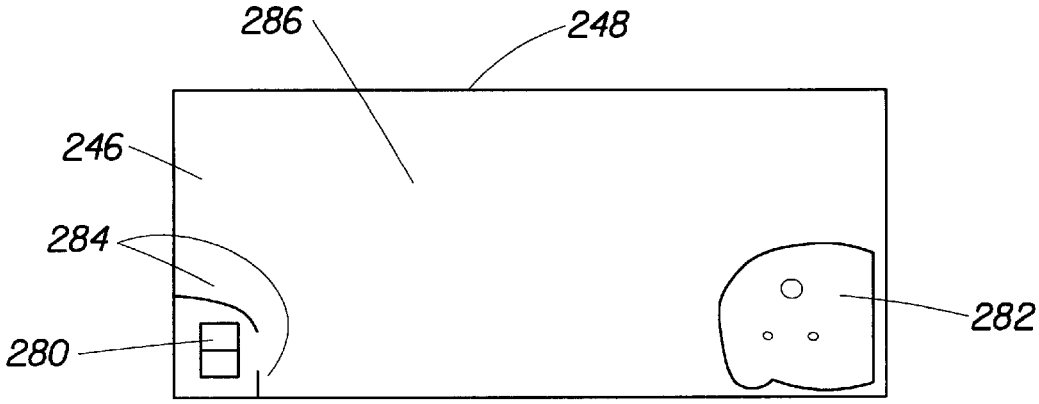
FIG. 23 is a plan view of an exemplary temperature changing element.
Figure 24:
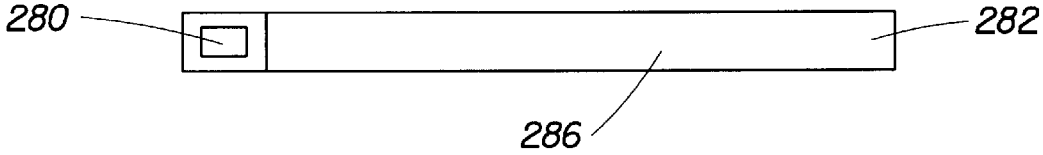
FIG. 24 is an elevational view of the exemplary temperature changing element of FIG. 23.

FIGS. 23 and 24 show another embodiment of a temperature changing element 5 including a supercooled aqueous salt solution(s) 282. This can facilitate manufacturing heat packs in a supercooled condition and activated with an internal release of heat when desired. Examplary salts include sodium acetate, sodium thiosulfate and calcium nitrate tetrahydrate. Activation disk 280 can be locked in an offset position in the element by seals 284 that form a small chamber from which the activation disk 280 cannot escape. As shown in FIGS. 9–18, temperature changing element 5 can comprise one or more attachment tabs 256 for attaching the temperature changing element 5 to structure of the heating package at various points.

Referring to FIG. 1A, package 30 can be activated by applying pressure to the offset activation point 40 of first chamber 9 that can be offset from item 12. This pressure breaks frangible seal 8, thereby releasing a first material (i.e. water) from first chamber 9 of temperature changing element 5. This material can then be channeled through a constriction to a bed of second material. Upon mixing of the first and second materials, chemical heating and/or cooling can occur. In the case of heating, energy generated by the reaction can then be transferred to item 12 in the form of heat. When cooling is desired, energy is removed from item 12. After sufficient time, package 30 can be opened and item 12 can then be removed and used, or used within package 30.

Insulation Layer

Package 30 can also include an insulation layer 3. Preferably, insulation layer 3 is directly adhered and/or coextensive with outer walls 1 using any method known in the art such as heat-sealing, adhesives, ultrasonics, etc. Insulation layer 3 can comprise materials including but not limited to foamed polyethylene, silicone rubber, fibrous cellulose structures, rigid thermoformed films having a plurality of depressions that can provide air pockets (i.e., lattice with a large amount of void space), and combinations thereof. In a preferred embodiment, two insulation pads, which are 3½-inch×5-inch (8.9 cm×12.7 cm) pieces of foamed PE (Volara™) of 60 mil (1.524 mm) thickness are attached to outer walls 1 by heat sealing along the top and bottom of either. Optionally, outer walls 1 can function as an insulation layer 3. This can be accomplished by providing the insulation layer 3 as a co-extruded, or laminate, structure with outer walls 1. In another embodiment, the insulation layer 3 can be an outer sleeve surrounding outer walls 1, and thus, package 30.

Preferably, insulation layer 3 will be larger in area than first chamber 7. This is desirous because first chamber 7 can preferably contain an exothermic/endothermic material. Thus, insulation layer 3 could separate the entire outer surface of first chamber 7 from the outside of package 30. This can prevent the outside surface of package 30 from becoming too hot, while also maintaining the heat inside the pouch to better heat the item contained within package 30. Additionally, insulation layer 3 may be integral to walls of temperature changing element 5.

Support Member

Referring again to FIG. 1, package 30 can also include a support member 10. Support member 10 is designed so that the item contained within package 30 is offset from the activation point 40. In this way, support member 10 can provide the offset activation point 40. Without wishing to be bound by theory, it is believed that providing support member 10 as a thin foil, or metallized film, can promote even heat transfer to the contained item 12 with the sealant layer on both sides of the film. This can allow the support member 10 to be attached to the inside surface of outer walls 1 or inside surface 6 of temperature changing element 5 and still be sealed on the opposite surface. Preferably, the attachment point for support member 10 is located at the top edge 2 of package 30 near opening 18. Then, support member 10 may be sealed to itself along side edges 16 of package 30 forming a pocket 13 to contain item 12.

In a preferred embodiment, support member 10 can be a sheet material that forms an inner 'U'-shaped pocket 13 for item 12. Further, the 'U'-shaped pocket 13 can offset item 12 from the offset activation point 40 of the package 30 so that the action of activation does not impact the item 12. It was surprisingly found that support member 10 can prevent direct contact between the temperature changing element 5 and the item 12 and also isolates the item 12 from the chemical reaction in case of chemical leakage. The softening point of the adhesive should be higher than that within package 30 if support member 10 is adhesively bonded to outer wall 1.

Figure 5:
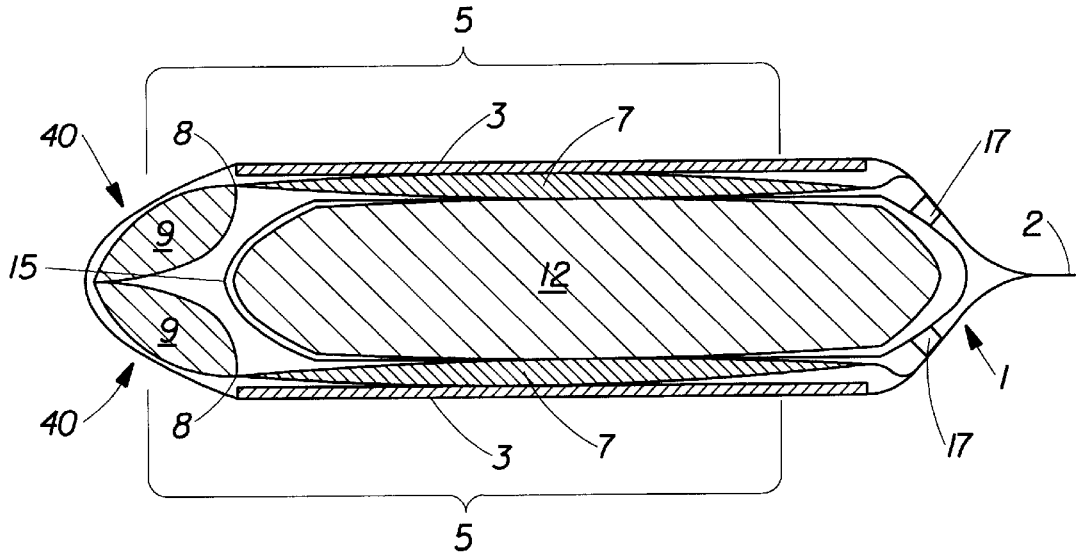
FIG. 5 is a cross-sectional view of an alternative embodiment of a package.

As shown in FIG. 5, this support member 10 can optionally be in the form of a separate closed sachet 15 containing the item 12, so that the item 12 is removed from closed sachet 15, and then removed from closed sachet 15 to use. This can also provide additional protection from any chemical elements as described supra. In this embodiment, the top of closed sachet 15 can be secured at the exit point of the outer sachet by a releasable adhesive or other means 17, to suspend the item away from the activation point 9 of the package 30.

Figure 6:
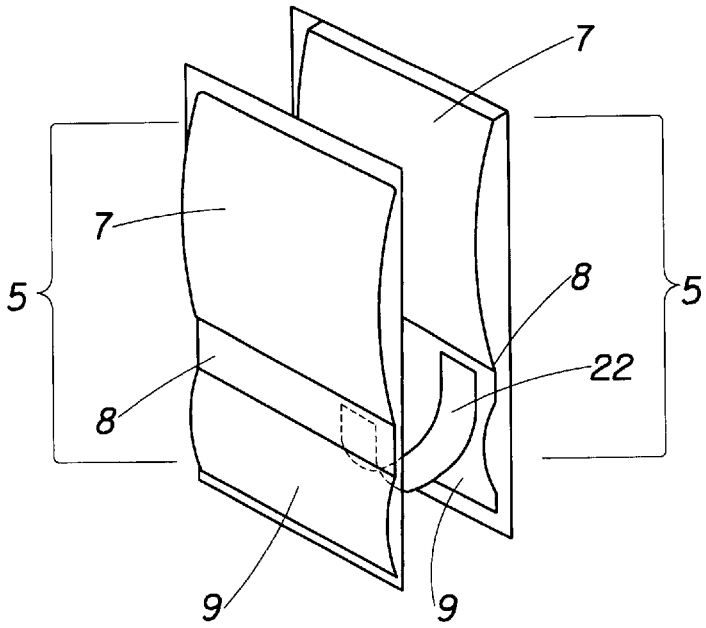
FIG. 6 is a perspective view of a plurality of temperature changing elements and a product support member.

As shown in FIG. 6, temperature changing element 5 can be supported above the activation point (which is also the first chamber 9) by using one or more strips 22 to form a sling. One or more strips 22 used in this manner can provide an offset to the item 12 yet provide little interference between item 12 and temperature changing element 5.

Package 30 can contain items 12 such as food items, moist (or dry) substrates, liquids, particles, or combinations thereof. Exemplary food items may include dough-wrapped food articles that are either shelf-stable or refrigeration-dependent, or multiple sized particles. The self-heating package 30 may be designed around the item 12 to be heated. If the item 12 is thick, the package 30 may require gusseting. However, it is envisioned that the package 30 is activated with one hand by compression of the end of the package 30 where the first chamber 9 containing the first material is located. The package 30 can be designed to provide a snug fit with the item 12 to minimize air gaps that can reduce system thermal energy transfer efficiency.

In an exothermic system, the reaction can cause the temperature changing element 5 to expand upon activation. This can position item 12 closer to temperature changing element 5, so heating does not need to rely on transfer through an air gap.

EXAMPLE 1

The material comprising outer walls 1 was a 5 mil (127 μm) paper/foil/LDPE laminate film, cut to a 5½-inch×14-inch (13.97 cm×35.56 cm) sheet. Two insulation pads 3 were formed from 3½-inch×5-inch (8.9 cm×12.7 cm) pieces of 60 mil (1.524 mm) foamed PE (Volara™). Temperature changing element 5 was made from a 3.5 mil (88.9 μm) metallized OPP (oriented polypropylene) and Surlyn™ laminate. Temperature changing element 5 contained 7 ml of water and 10 g of a 2:1 anhydrous citric acid (granule):anhydrous calcium oxide (powder) mixture. Temperature changing element 5 was attached to the outer walls 1 on top of the insulation pads 3 by heat sealing the exposed sealant layer of the temperature changing element 5 to the sealing layer of the outer walls 1. The foil liner was manufactured from a 4½-inch×10-inch (11.43 cm×25.4 cm) piece of 1.5 mil (38.1 μm) metallized OPP and Surlyn™ laminate film. The foil liner was then folded to form a gusseted or flat pouch. The pouch was then heat sealed along two outer edges 2, and a PopTart™ weighing 50 g was inserted. The pouch was then sealed along top edges 2.

Alternate Embodiments

Figure 19:
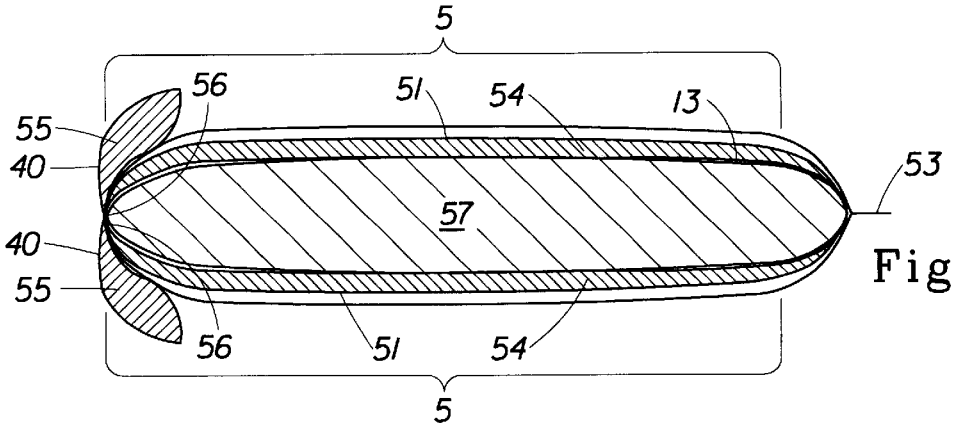
FIG. 19 is a cross-sectional view of an alternative embodiment of a package.

As shown in FIG. 19, package 30 can include two temperature changing elements 5 adhesively or thermally attached to each other around the peripheral edge of second chamber 54 of temperature changing element 5. In other words, three side edges of second chamber 54 form an inner pocket 13 for holding an item 57. Temperature changing element 5 can also include a first chamber 55 incorporating activation point 40 and frangible seal 56. By sealing the package around the peripheral edge of the second pocket 54, pocket 13 can maintain item 57 in an offset position from the activation point 40 of first chamber 55. This can facilitate folding temperature changing element 5 along the frangible seal 56 (i.e., first chamber 55 is folded to overlay second chamber 54) to prevent unintentional activation. Additionally, insulator layer 51 can be added, coextensively or externally, to temperature changing element 5. Chamber 54 can be sealed across the top edge 53 for closure. Formation of the package can also be accomplished by designing temperature changing element 5 so that an outer sheet comprising temperature changing element 5 is larger than an inner sheet, thereby exposing the inner layer of the outer sheet. This inner layer of the outer sheet may be polymeric in nature and can be sealed along the two side edges 58 and the top edge 53 to provide a mirror image of the other temperature changing element 5.

Figure 20:
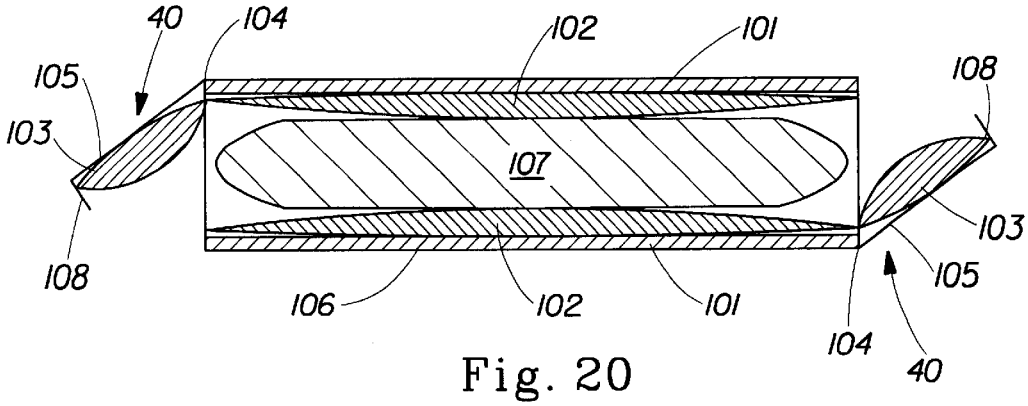
FIG. 20 is a cross-sectional view of an alternative embodiment of a package.

As shown in FIG. 20, a system comprising one or more sides 106 of a paperboard box can be lined with at least one temperature changing element 5 and an insulator 101 disposed thereabout. Frangible seal 104 of the temperature changing element 5 can be co-located along the seam of the fold of end flaps 105 of the box 30. Thus, when the flaps of box 30 are closed, the frangible seal 104 is folded, reinforcing frangible seal 104 and reducing the likelihood of an unintended activation of the temperature changing element 5. Activation of the system could require opening the box and applying pressure to a first chamber 103 located on the flap 105 to rupture the frangible seal 104. Upon rupture of the frangible seal 104, a first material in chamber 103 is caused to contact a second material contained in a second chamber 102. End flaps 105 can be re-closed by use of an insertion tab 108 while an item 107 located within pocket 13 is heated. The item 107 may be enclosed in a protective wrap or pouch to prevent contamination. The temperature changing elements 5 are attached via a suitable adhesive, or heat-sealing to a polymer coated paperboard.

Figure 21:
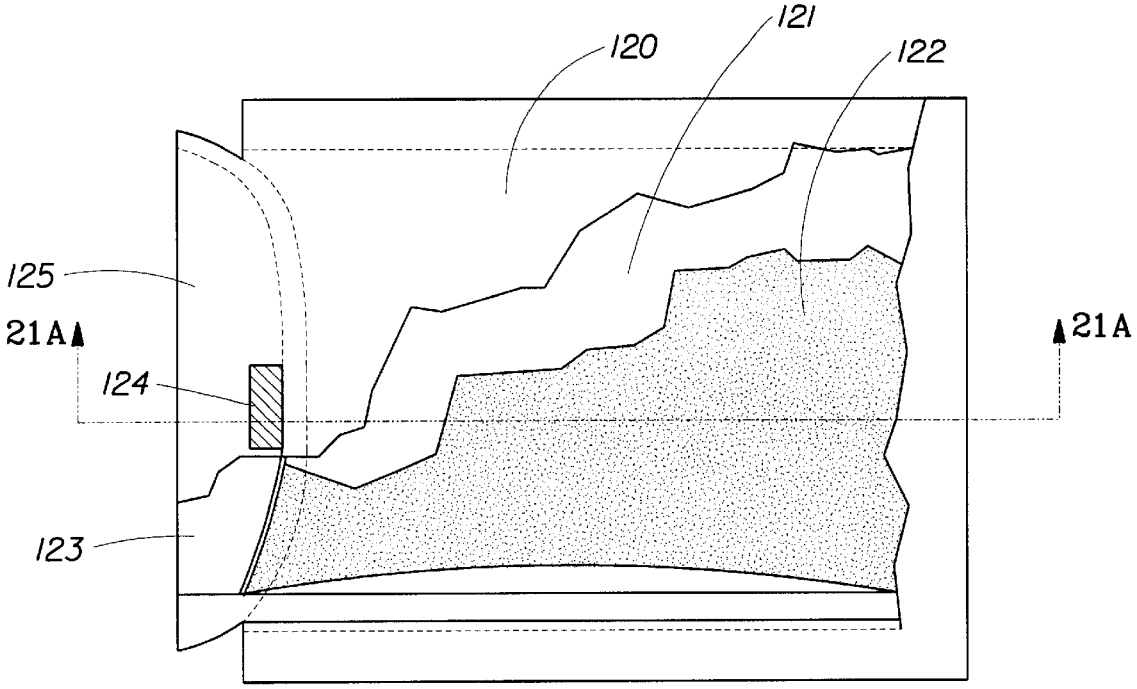
FIG. 21 is a plan view of an alternative embodiment of a package.
Figure 21A:
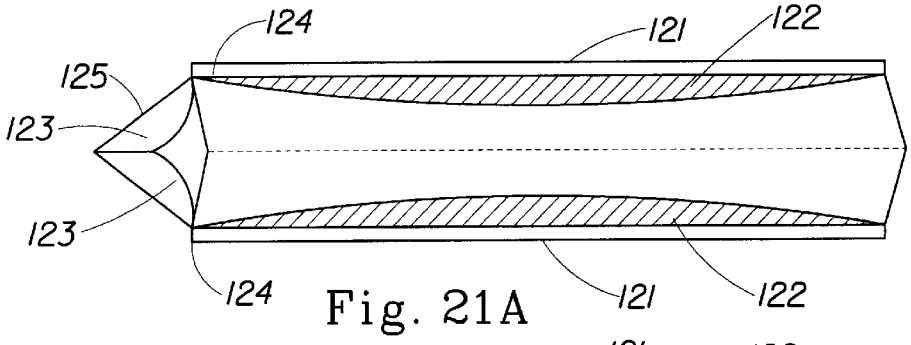
FIG. 21A is a cross-sectional view of the embodiment of FIG. 21 taken along the line 21A—21A.
Figure 21B:
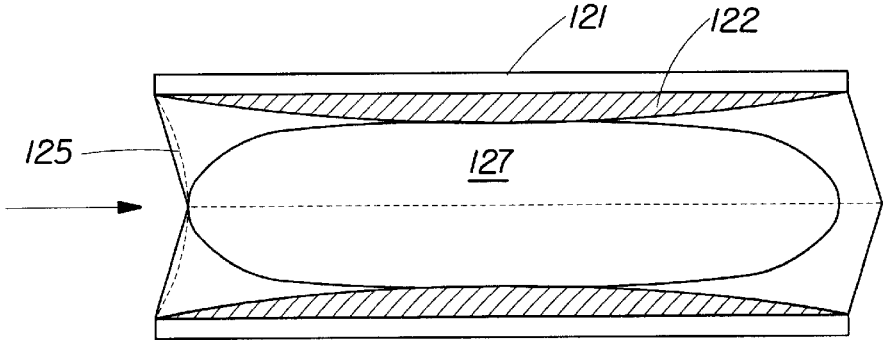
FIG. 21B is a cross-sectional view of the embodiment of FIG. 21 taken along the line 21A—21A with the package fully expanded.

As shown in FIGS. 21, 21A, and 21B, the box 120 can be a "pop-open" box that is dispensed in a flat form, shown in FIG. 21A, and opened by pressing the bottom 125 until it locks, as shown in FIG. 21B. The user may then place an item 127 in the box 120 to be heated. As shown in FIGS. 21, 21A and 21B, box 30 can include an insulation layer 121, a first chamber 123, a second chamber 122, and a frangible seal 124 separating or joining both chambers.

Figure 22:
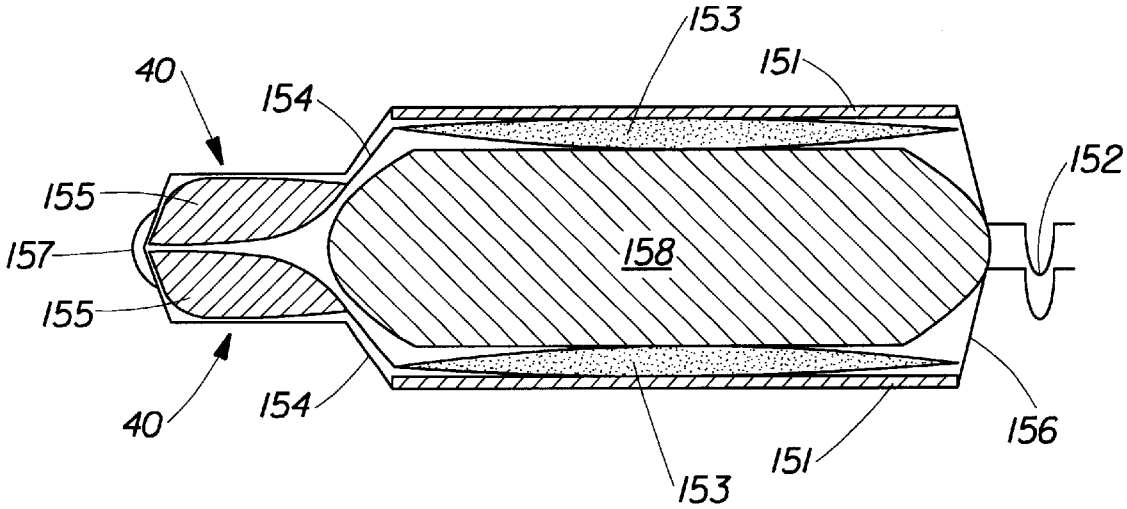
FIG. 22 is a cross-sectional view of an alternative embodiment of a package.

FIG. 22 depicts a thermoformed carton, or other shaped material 156 resembling a clamshell design, and including insulation layers 151 and temperature changing element 5, folded along a hinge 157. Temperature changing element 5 includes a first chamber 155, a second chamber 153, and a frangible seal 154 disposed between the first chamber 155 and the second chamber 153. The upper and lower halves of the thermoformed carton are designed to include a reservoir to provide a location to hold first chamber 155 of temperature changing element 5. The reservoir can be located at either hinge 157 shown in FIG. 22, or at the opening 132. Both the upper and lower halves of the thermoformed carton can include temperature changing element 5. The thermoformed carton can be provided with a closure mechanism 152, for instance, a mating notch. The user activates the system by applying pressure to the first chamber 155, thereby forcing material out of first chamber 155, through the channel 154, and into the second chamber 153 located on either side of the item 158.

Additionally, a thermochromatic indicator that signals item readiness can be incorporated into any of the systems described supra. This indicator can indicate the time required to heat an item based on a given environment. Additionally, easy open features such as tear notches, tear strips, or perforation may be added, and reuse features such as Ziploc® or food grade pressure-sensitive adhesives may be added.

The foregoing examples and descriptions of the preferred embodiments of the invention have been presented for purposes of illustration and description only. They are not intended to be exhaustive or to limit the invention to the precise forms disclosed, and modifications and variations are possible and contemplated in light of the above teachings. While a number of preferred and alternate embodiments, systems, configurations, methods, and potential applications have been described, it should be understood that many variations and alternatives could be utilized without departing from the scope of the invention.

What is claimed is:

1. A flexible heating/cooling system comprising:

an enclosed package containing a product;

at least two flexible temperature changing elements, each of said flexible temperature changing elements comprising:

a first chamber; and, a second chamber disposed proximate to said first chamber;

wherein at least a portion of said at least two flexible temperature changing elements is disposed proximate to said product;

a support member disposed between said at least two flexible temperature changing elements, said product being supportable between said at least two flexible temperature changing elements by said support member; and, wherein thermal energy from said at least two flexible temperature changing elements heats or cools said product.

2. The flexible heating/cooling system of claim 1 wherein said flexible heating/cooling system is disposed in an insulator.

3. The flexible heating/cooling system of claim 2 wherein said at least two flexible temperature changing elements are coextensive with said enclosed package.

4. The flexible heating/cooling system of claim 3 wherein said insulator is coextensive with said at least two flexible temperature changing elements.

5. The flexible heating/cooling system of claim 1 wherein said first chamber further comprises an activation point.

6. The flexible heating/cooling system of claim 5 wherein said activation point is disposed away from said product.

7. The flexible heating/cooling system of claim 1 wherein said at least two temperature changing elements are coextensive with said enclosed package.

8. The flexible heating/cooling system of claim 1 wherein said thermal energy is produced from a chemical reaction.

9. The flexible heating/cooling system of claim 8 wherein said chemical reaction is exothermic.

10. The flexible heating/cooling system of claim 8 wherein said chemical reaction is endothermic.

11. The flexible heating/cooling system of claim 8 wherein said chemical reaction is a chemical reaction selected from the group consisting of solid-liquid, liquid—liquid, anhydrous heat of solution, heat of neutralization, zeolite-liquid, crystallization, electro-chemical, and combinations thereof.

12. The flexible heating/cooling system of claim 1 wherein said enclosed package is manufactured from a material selected from the group consisting of foils, metallized films, and combinations thereof.

13. The flexible heating/cooling system of claim 1 further comprising attachment tabs wherein said attachment tabs attach said at least two flexible temperature changing elements to said enclosed package.

14. The flexible heating/cooling system of claim 1 wherein said second chamber is disposed proximate to said enclosed package.

15. The flexible heating/cooling system of claim 14 wherein said first chamber is at least partially disposed away from said product.

16. The flexible heating/cooling system of claim 1 further comprising a rupturable barrier disposed between said first chamber and said second chamber.

17. The flexible heating/cooling system of claim 16 wherein said rupturable barrier is selected from the group consisting of frangible seals, perforations, scoring, weak regions, internal piercing, pull-strips, and combinations thereof.

18. The flexible heating/cooling system of claim 1 wherein said at least two flexible temperature changing elements are simultaneously activatable.

19. A flexible, self-heating/self-cooling package for heating or cooling an item contained within said package, said package comprising:

a product;

at least two flexible temperature changing elements disposed proximate to said product;

wherein each of said at least two flexible temperature changing elements has at least one first side;

a support member disposed adjacent at least one of said temperature changing elements; and, wherein at least a portion of each of said first sides of said flexible temperature changing elements are disposed about said product, when said product is proximate to said support member.

20. The self-heating/self-cooling package of claim 19, wherein each of said at least two temperature changing element comprises:

a first compartment;

a second compartment; and, a rupturable seal disposed between said first and second compartments; and, wherein at least a portion of said first compartment is disposed away from said product.

* * * * *